United States Patent [19]

Baugh et al.

[11] Patent Number: 4,901,794

[45] Date of Patent: Feb. 20, 1990

[54] SUBTERRANEAN WELL ANCHORING APPARATUS

[75] Inventors: John L. Baugh, Houston; Sidney K. Smith, Jr., Huntsville, both of Tex.

[73] Assignee: Baker Hughes Incorporated, Houston, Tex.

[21] Appl. No.: 300,436

[22] Filed: Jan. 23, 1989

[51] Int. Cl.[4] ..... E21B 33/129

[52] U.S. Cl. ..... 166/118; 166/134; 166/138; 166/217; 277/236; 285/146

[58] Field of Search ..... 166/209, 118, 134, 137, 166/138, 179, 182, 210, 211, 215, 216, 217; 285/144, 146, 382, 382.1, 382.2, 382.4; 277/117, 118, 115, 236 X, 190

[56] References Cited

U.S. PATENT DOCUMENTS

| | | | |
|---|---|---|---|
| 2,021,223 | 11/1935 | Church | 166/182 |
| 2,155,380 | 4/1939 | Bean | 166/217 |
| 2,230,712 | 2/1941 | Bendeler et al. | 166/182 |
| 3,298,440 | 1/1967 | Current | 166/134 |
| 3,344,861 | 10/1967 | Claycomb | 166/182 |
| 3,389,918 | 6/1968 | Burns | 277/118 |
| 3,570,600 | 3/1971 | Wall | 166/217 |
| 3,623,551 | 11/1971 | Randermann Jr. | 166/217 |
| 4,573,537 | 3/1986 | Hirasuna et al. | 166/134 |
| 4,791,987 | 12/1988 | Cassity et al. | 166/182 |

*Primary Examiner*—Bruce M. Kisliuk

*Attorney, Agent, or Firm*—Hubbard, Thurman, Turner & Tucker

[57] ABSTRACT

The present invention provides an apparatus for anchoring of equipment within the interior bore of a section of a subterranean well conduit, and particularly for insertion of such equipment. The apparatus comprises a cylindrical housing and a conically tapered surface around the exterior of the housing which is radially larger at its upper end and tapered to a radially smaller lower end. A seal body is provided which is carried exteriorly around the housing and has its interior tapered end reverse to that of the conically tapered surface around the housing and which is selectively longitudinally movable relative to the housing from a first, unset position on the conduit section to a second, set position on the conduit section and radially expandable during the movement relative to the housing. Anchoring means are carried exteriorly around the body for securing the apparatus to the conduit section against upward and downward movement of the apparatus. A bi-directional anchoring system is provided such that force received on or through either end of the apparatus drives the apparatus into further anchoring engagement with the conduit section. A metal-to-metal primary and elastomeric secondary seal system are provided on the apparatus with the secondary elastomeric seal having zero extrusion and slip body having a ductility of from between about 1% and about 15%.

19 Claims, 1 Drawing Sheet

SUBTERRANEAN WELL ANCHORING APPARATUS

1. FIELD OF THE INVENTION

The invention provides an apparatus for anchoring of a subterranean well tool to a conduit, such as casing or tubing, or for anchoring of auxiliary tools within the interior bore of a section of a subterranean well conduit.

2. DESCRIPTION OF THE PRIOR ART

In this specification, the term "conduit" will be understood to refer to well pipe, tubing, casing, etc. The term "auxiliary tools" will be understood to mean devices of the type used in conducting wellbore operations including landing collar inserts, flapper valves, back pressure check valves, ball catching subs, baffle type catcher subs, valve type orifice float collars, orifice float collars, cementing bridge plugs, cementing retainers, cementing set shoes, plugs and flowlines and similar equipment. The term "grit-like" will be understood to refer to sand or sand-like particles which form a highly abrasive surface.

In the past, the required wellbore equipment was typically provided in a specialized pipe sub which would be made up into the pipe string of the customer. Prior art designs were not entirely satisfactory because some customers utilized pipe strings with custom threads which would not match the threads of the specialized pipe sub, or which would require cutting special threads on the specialized sub.

U.S. Pat. No. 4,248,400, entitled "METHOD OF AND APPARATUS FOR POSITIONING RETRIEVABLE LANDING NIPPLE IN A WELLBORE STRING", is typical of prior art devices in which a landing collar is run into the wellbore on a pipe string and secured within a surrounding well conduit. The landing collar is latched into a specially milled grooved in the surrounding conduit.

U.S. Pat. No. 4,399,873, entitled "RETRIEVABLE INSERT LANDING ASSEMBLY" shows another landing assembly which is run into the interior bore of a packer and which is engaged to provide a landing shoulder within the packer by latching the device within a groove nailed within the bore of the pacer.

U.S. Pat. No. 4,600,058 entitled "EQUIPMENT INSERT AND METHOD" is an advancement in the art. However, such device still requires the removal of certain component parts for securement thereto of several types of auxiliary tools.

Such prior art devices suffer from the deficiency of requiring special milling of the surrounding conduit or special couplings and threads in the surrounding conduit are otherwise not entirely satisfactory because they are not completely modular for acceptance of a host of auxiliary tools, do not provide resistance to pressure exerted upon the device from below as above the device when set within the conduit, and/or do not provide a highly efficient seal system for sealing along the smooth cylindrical interior bore of the well conduit section.

SUMMARY OF THE INVENTION

The present invention provides an apparatus for anchoring of equipment within the interior bore of a section of a subterranean well conduit, and particularly for insertion of such equipment. The apparatus comprises a cylindrical housing and a conically tapered surface around the exterior of the housing which is radially larger at its upper end and tapered to a radially smaller lower end. A seal body is provided which is carried exteriorly around the housing and has its interior tapered end reverse to that of the conically tapered surface around the housing and which is selectively longitudinally movable relative to the housing from a first, unset position on the conduit section to a second, set position on the conduit section and radially expandable during the movement relative to the housing. Anchoring means are carried exteriorly around the body for securing the apparatus to the conduit section against upward and downward movement of the apparatus. A bi-directional anchoring system is provided such that force received on or through either end of the apparatus drives the apparatus into further anchoring engagement with the conduit section. A metal-to-metal primary and elastomeric secondary seal system are provided on the apparatus with the secondary elastomeric seal having zero extrusion and slip body having a ductility of from between about 1% and about 15%.

DESCRIPTION OF THE PREFERRED EMBODIMENTS

Figure 1:
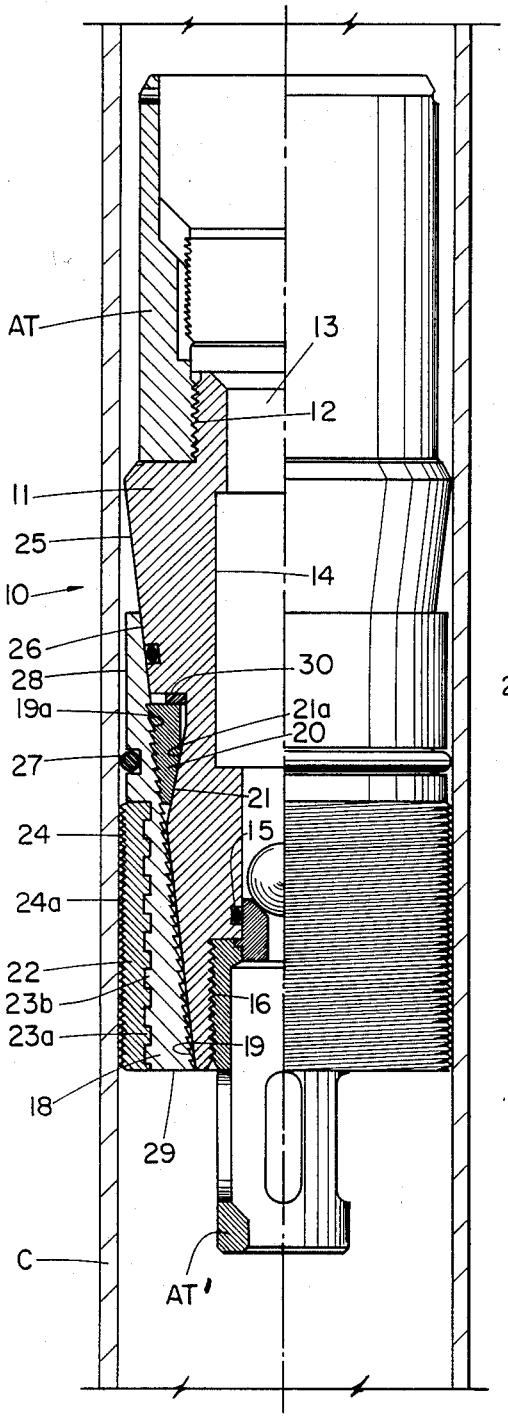
FIG. 1 is a partional cross-sectional view of the apparatus of the present invention in the form of an insert apparatus for auxiliary tools, said apparatus being shown in the unset position relative to a conduit.
Figure 2:
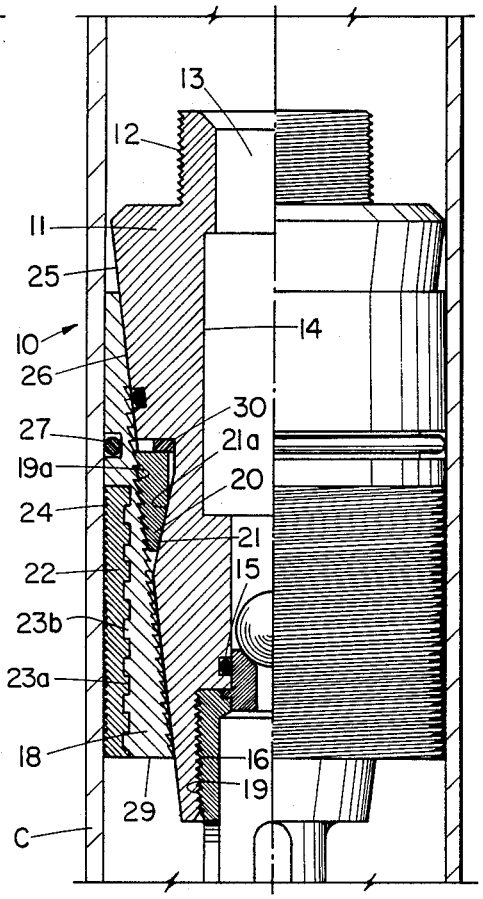
FIG. 2 is a view similar to that of FIG. 1 showing the apparatus in the set position.

Now referring to FIGS. 1 and 2 there is shown within the interior of a casing well conduit section C the apparatus 10. As shown in FIG. 2, the apparatus 10 has secured at one end of it a housing for an auxiliary tool AT and has threadably secured at its lowermost end a housing for a second auxiliary tool AT'. It will be appreciated that such auxiliary tools AT and AT' may take on a number of embodiments, as set forth above.

The apparatus 10 comprises a cylindrical housing member 11 having at one end thereof threads 12 for securement of an auxiliary tool AT, as shown. A passageway 13 is provided through the interior of the housing 11 to permit fluid communication therethrough or for transmission by means of wireline, or the like, of conduits and tools therethrough. The housing 11 has within its central section a receiving groove 14 circumferentially extending therearound for receipt of, for example, a member containing chevron or other appropriate sealing means to act as a packoff bushing during conventional cementing operations of subterranean wells. The housing 11 also has defined below the receiving groove 14 and carried interiorly around the housing 11 an elastomeric O-ring seal element 15 to provide sealing integrity between the housing 11 and either a setting tool (not shown) disposed therethrough during the setting operation, or an auxiliary tool AT carried within the apparatus 10. Threads 16 are provided at the lowermost end of the apparatus 10 on the housing 11 for securement thereto of either a lower auxiliary tool AT or of the setting tool mechanism, which may be of known construction and operation, which is utilized during the setting of the apparatus 10 relative to the conduit C. When such setting tool is secured to the threads 16, such setting tool may be expected to have a shifting sleeve in engagement with the lower end 29 of the seal ring 18 carried around the exterior of the housing 11, such that one portion of the setting tool which is secured to the threads 16 in combination with the sleeve portion of the setting tool in operational contact engagement with the lower end 29 of the seal ring 18 will permit relative longitudinal motion between the seal ring 18 and the housing 11, as described below.

The housing 11 also provides circumferentially around its exterior an elastomeric O-ring seal element 17 to prevent fluid communication between the housing 11 and the seal ring 8.

The seal ring 18 has on its interior a series of ratcheting teeth 19 for companion interengagement with ratchet teeth 19*a* carried on and facing outwardly of a ratchet ring 20. The ratchet ring 20 is housed within a groove circumferentially subscribed around the exterior of the housing 11 having a bevel 21 profiled thereon, with the ratechet ring 20 having a companionly profiled bevel 21*a*. A biasing means, such as an elastomeric O-ring element 30 is housed within the housing 11 above the ratchet ring 20 and serves to bias the ratchet ring 20 toward outward position by urging the ratchet ring 20 longitudinally downwardly along the bevel 21*a* of the housing 11.

The housing 11 has its central section in a bevel configuration 25 which is conically tapered, the taper being radially enlarged at its upper end and tapering to a radially smaller lower end along the housing 11. A companion reverse bevel 26 is provided along the interior-facing surface of the seal ring 18, this taper being in reverse to that of the conically tapered bevel 25 of the housing 11 such that the companion bevel or tapered surface 26 on the seal ring 18 is smaller at the uppermost end thereof and is at its largest at the lowermost end thereof.

The seal ring 18 has a seal wedge surface 28 at its uppermost end section which, when the apparatus 10 is manipulated to the set position relative to the conduit C, provides a metal-to-metal seal between the exterior of the seal ring 18 and the interior smooth cylindrical bore of the conduit C.

Such metal-to-metal sealing engagement provides the primary sealing system for the apparatus 10. A secondary elastomeric seal is provided in the form of an elastomeric circumferentially extending O-ring element 27 implaced within the seal ring 18 just below the seal surface 28. Because the seal ring 18 has a ductility of from between about 1% and about 15%, the metal-to-metal seal surface 28 is considerably ductile thereby enabling the secondary elastomeric seal to be non-extruding.

Anchoring means 22 are provided securely around the exterior of the seal ring 18 by means of the interengagement of the threads 23*a*, 23*b*. As shown, a grit-like material surface 24*a* has been implaced upon the anchoring means 22 and on the peaks and valleys of the thread system thereon to provide additional anchoring integrity when the apparatus 10 is gripping engaged relative to the conduit C.

OPERATION

In order to manipulate the apparatus 10 from the unset position shown in FIG. 1 to the set position shown in FIG. 2 relative to the conduit C, a conventional setting tool (not shown) is secured to the apparatus 10 at the top of the well before the conduit section is made up into a conduit string. The location of the apparatus 10 relative to the conduit section is identified and the setting tool, which is secured to the threads 16 and operationally associated with the lower end 29 of the seal ring 18 is manipulated to cause relative longitudinal movement between the housing 11 and the seal ring 18. As such movement is initiated, the ratchet teeth 19 and 19*a* will cause a ratcheting affect and the ratchet ring 20 will permit movement of the seal ring 18 relative to the housing 11 in only one direction. The ratcheting setting motion is transferred to the seal ring 18 which moves along the bevel 25 of the housing 11, urging the anchoring means 22 and the anchoring teeth 24 thereon toward anchoring engagement along the conduit C. The seal wedge surface becomes engaged with the cylindrical interior bore of the conduit C to provide a metal-to-metal seal therebetween and the elastomeric O-ring seal element 27 sealingly engages the conduit C below the metal-to-metal seal, as provided. Now, there is a primary as well as a non-extruding secondary seal between the apparatus 10 and the conduit C. It will be appreciated that the ratchet ring 20 will permit movement of the seal ring 18 relative to the housing 11 in only one direction and will be prevent movement between the ring 18 and housing 11 in the opposite direction by means of the profile of the teeth on the ratchet ring 20 and the bevels 21, 21*a* provided therebetween. The biasing ring element 30 will urge the ratchet ring 20 downwardly and outwardly along the bevel 21 to maintain ratchet engagement between the housing 11 and seal ring 18.

When in the set position as shown in FIG. 2, it will now be appreciated that hydraulic pressure or mechanical force transferred to or through the apparatus 10 at the uppermost end of the housing 11 will be transferred through the housing 11, the ratchet ring 12, the seal ring 18 and finally into the anchoring means 22 to continue to drive the anchoring means 22 into engagement with the conduit C. Bi-directional anchoring engagement is also provided in the event that such similar forces are directed to or transferred through the lowermost end of the housing 11. Such forces will be transferred from the housing 11 to the seal ring 18 through the teeth 19, 19*a*, and directly to the anchoring means 22. Thus, forces acting upon the apparatus 10 from either upwardly or lowerly thereof while the apparatus is in set position relative to the conduit C will add additional anchoring force through the apparatus 10 to the conduit C, further assuring anchoring and sealing integrity of the apparatus 10 relative to the conduit C.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is desired to be claimed and secured by Letters Patent is:

1. Apparatus for anchoring of equipment within the interior bore of a section of a subterranean well conduit, comprising:

(1) a cylindrical housing;

(2) a conically tapered surface around the exterior of said housing, said surface being radially enlarged at its upper end and tapering to a radially smaller lower end;

(3) a seal body carried exteriorly around said housing and having its interior tapered and reverse to that of said conically tapered surface around said housing and selectively longitudinally movable relative to said housing from a first, unset position on said conduit section to a second, set position on said conduit section and radially expandable during said movement relative to said housing;

(4) anchoring means carried exteriorly around said seal body for securing said apparatus to said conduit section against upward and downward movement of said apparatus;

(5) a carbide grit-like material disposed on the exterior of said anchoring means;

(6) ratcheting means between said housing and said seal body permitting movement between said housing and said seal body in one direction and resisting movement between said housing and said body in the opposite direction; and (7) means for transferring downward force applied upon said apparatus through said housing, said ratcheting means, said seal body and said anchoring means, to said conduit section, and means transferring upward force applied upon said apparatus through said housing, said seal body and said anchoring means to said conduit section when said apparatus is in said engaged position within said conduit section.

2. The apparatus of claim 1 further comprising means on said seal body for formation of a primary metal-to-metal seal with said conduit section when said apparatus is in said engaged position.

3. The apparatus of claim 1 further comprising means on said seal body for formation of a primary metal-to-metal seal with said conduit section when said apparatus is in said engaged position and a zero extrusion elastomeric seal means circumferentially carried exteriorly around said seal body for non-extruding sealing engagement with the conduit section when said apparatus is in said engaged position.

4. The apparatus of claim 1 wherein said seal body has a ductility of from between about 1% and about 15%.

5. The apparatus of claim 1 further comprising biasing means for urging said ratcheting means into ratcheting operation.

6. The apparatus of claim 1 further comprising elastomeric O-ring biasing means for urging said ratcheting means into ratcheting operation.

7. Apparatus for insertion of equipment within the interior bore of a section of a subterranean well conduit at the well surface prior to making up the section of conduit into a conduit string, the well conduit being of the type having threaded surfaces at the opposite ends thereof for engaging mating threading surfaces of the adjoining conduit sections in the well conduit string and having a cylindrical interior bore, comprising:

(1) a cylindrical housing;

(2) a conically tapered surface around the exterior of said housing, said surface being enlarged at its upper end and tapering to a radially smaller lower end;

(3) a seal body carried exteriorly around said housing and having its interior tapered and reverse to that of said conically tapered surface around said housing and selectively longitudinally movable relative to said housing from a first, unset position on said conduit section to a second, set position on said conduit section and radially expandable during said movement relative to said housing;

(4) anchoring means carried exteriorly around said seal body for securing said apparatus to said conduit section against upward and downward movement of said apparatus; and (5) a carbide grit-like material disposed on the exterior of said anchoring means.

8. The apparatus of claim 7 further comprising ratcheting means between said housing and said seal body permitting movement between said housing and said seal body in one direction and resisting movement between said body and said housing in the opposite direction.

9. The apparatus of claim 8 further comprising means for transferring downward force applied upon said apparatus through said housing, said ratcheting means, said seal body and said anchoring means to said conduit section, and means for transferring upward force applied upon said apparatus through said housing, said seal body and said anchoring means to said conduit section when said apparatus is in said engaged position within said conduit section and said section is made up into said conduit string.

10. The apparatus of claim 7 further comprising means on said seal body for formation of a primary metal-to-metal seal with said conduit section when said apparatus is in said engaged position.

11. The apparatus of claim 7 further comprising means on said seal body for formation of a primary metal-to-metal seal with said conduit section when said apparatus is in said engaged position and a zero extrusion elastomeric means circumferentially carried exteriorly around said seal body for non-extruding sealing engagement with the conduit section when said apparatus is in said engaged position relative to said conduit section.

12. The apparatus of claim 7 wherein said seal body has a ductility of from between about 1% and about 15%.

13. The apparatus of claim 8 further comprising biasing means for urging said ratcheting means into ratcheting operation.

14. The apparatus of claim 8 further comprising biasing means for urging said ratcheting means into ratcheting operation, said biasing means comprising an elastomeric O-ring seal element.

15. The apparatus of claim 1 or claim 7 further comprising means on said apparatus for carryable receipt of at least one auxiliary tool.

16. Apparatus for anchoring of equipment within the interior bore of a section of a subterranean well conduit, comprising:

(1) a cylindrical housing;

(2) a conically tapered surface around the exterior of said housing, said surface being radially enlarged at its upper end and tapering to a radially smaller lower end;

(3) a seal body carried exteriorly around said housing and having its interior tapered in reverse to that of said conically tapered surface around said housing and selectively longitudinally movable relative to said housing from a first, unset position on said conduit section to a second, set position on said conduit section and radially expandable during said movement relative to said housing;

(4) anchoring means comprising a series of serrated hardened anchoring teeth having implaced thereon a layer of carbide grit-like material and carried exteriorly around said seal body for securing said apparatus to said conduit section against upward and downward movement of said apparatus;

(5) a carbide grit-like material disposed on the exterior of said anchoring means;

(6) ratcheting means between said housing and said seal body permitting movement between said housing and said seal body in one direction and resisting movement between said housing and said body in the opposite direction; and (7) means for transferring downward force applied upon said apparatus through said housing, said ratcheting means, said seal body and said anchoring means, to said conduit section, and means transferring upward force applied upon said apparatus through said housing, said seal body and said anchoring means to said conduit section when said apparatus is in said engaged position within said conduit section.

17. Apparatus for anchoring of equipment within the interior bore of a section of a subterranean well conduit, comprising:

(1) a cylindrical housing;

(2) a conically tapered surface around the exterior of said housing, said surface being radially enlarged at its upper end and tapering to a radially smaller lower end;

(3) a seal body carried exteriorly around said housing and having its interior tapered in reverse to that of said conically tapered surface around said housing and selectively longitudinally movable relative to said housing from a first, unset position on said conduit section to a second, set position on said conduit section and radially expandable during said movement relative to said housing;

(4) anchoring means comprising a series of serrated anchoring teeth having implaced thereon a layer of carbide grit-like material and carried exteriorly around said seal body for securing said apparatus to said conduit section against upward and downward movement of said apparatus;

(5) a carbide grit-like material disposed on the exterior of said anchoring means;

(6) ratcheting means between said housing and said seal body permitting movement between said housing and said seal body in one direction and resisting movement between said housing and said body in the opposite direction; and (7) means for transferring downward force applied upon said apparatus through said housing, said ratcheting means, said seal body and said anchoring means, to said conduit section, and means transferring upward force applied upon said apparatus through said housing, said seal body and said anchoring means to said conduit section when said apparatus is in said engaged position within said conduit section.

18. Apparatus for insertion of equipment within the interior bore of a section of a subterranean well conduit at the well surface prior to making up the section of conduit into a conduit string, the well conduit being of the type having threaded surfaces at the opposite ends thereof for engaging mating threading surfaces of the adjoining conduit sections in the well conduit string and having a cylindrical interior bore, comprising:

(1) a cylindrical housing;

(2) a conically tapered surface around the exterior of said housing, said surface being enlarged at its upper end and tapering to a radially smaller lower end;

(3) a seal body carried exteriorly around said housing and having its interior tapered and reverse to that of said conically tapered surface around said housing and selectively longitudinally movable relative to said housing from a first, unset position on said conduit section to a second, set position on said conduit section and radially expandable during said movement relative to said housing; and (4) anchoring means comprising a series of serrated hardened anchoring teeth having implaced thereon a layer of carbide grit-like material and carried exteriorly around said seal body for securing said apparatus to said conduit section against upward and downward movement of said apparatus.

19. Apparatus for insertion of equipment within the interior bore of a section of a subterranean well conduit at the well surface prior to making up the section of conduit into a conduit string, the well conduit being of the type having threaded surfaces at the opposite ends thereof for engaging mating threading surfaces of the adjoining conduit sections in the well conduit string and having a cylindrical interior bore, comprising:

(1) a cylindrical housing;

(2) a conically tapered surface around the exterior of said housing, said surface being enlarged at its upper end and tapering to a radially smaller lower end;

(3) a seal body carried exteriorly around said housing and having its interior tapered and reverse to that of said conically tapered surface around said housing and selectively longitudinally movable relative to said housing from a first, unset position on said conduit section to a second, set position on said conduit section and radially expandable during said movement relative to said housing; and (4) anchoring means comprising a series of serrated anchoring teeth having implaced thereon a layer of carbide grit-like material and carried exteriorly around said seal body for securing said apparatus to said conduit section against upward and downward movement of said apparatus.

* * * * *